US006497276B2

(12) United States Patent
Clark et al.

(10) Patent No.: US 6,497,276 B2
(45) Date of Patent: Dec. 24, 2002

(54) COMBINED REFRIGERATOR-OVEN APPARATUS

(76) Inventors: Ron D. Clark, 18231 N. 46th St., Phoenix, AZ (US) 85032; Mark A. George, 18235 N. 46th St., Phoenix, AZ (US) 85032

( * ) Notice: Subject to any disclaimer, the term of this patent is extended or adjusted under 35 U.S.C. 154(b) by 41 days.

(21) Appl. No.: 09/823,631

(22) Filed: Mar. 31, 2001

(65) Prior Publication Data

US 2002/0170303 A1 Nov. 21, 2002

(51) Int. Cl.[7] ..... F25D 15/00; H05B 6/50

(52) U.S. Cl. ..... 165/206; 165/267; 165/62; 165/63; 165/64; 126/39 C; 126/39 G; 126/21 A; 126/273 R; 62/331; 99/327; 99/352; 99/357; 219/702; 219/714; 219/719

(58) Field of Search ..... 165/267, 206, 165/48.1, 58, 62, 64, 63; 126/39 C, 39 F, 39 G, 19 R, 84, 25 R, 273 R, 273.5, 274, 275 R, 275 E, 21 R, 21 A; 62/196.4, 331, 430; 99/327, 328, 335, 352, 357; 221/150 R, 150 HC; 219/679, 757, 702, 714, 719

(56) References Cited

U.S. PATENT DOCUMENTS 2,091,292 A * 8/1937 Scurlock
2,504,794 A * 4/1950 Berman et al.
2,616,269 A * 11/1952 Reynolds
2,823,902 A * 2/1958 Reynolds
3,353,476 A * 11/1967 Goodman et al.
3,516,485 A * 6/1970 Rhoads et al.
3,608,627 A * 9/1971 Shevlin
3,797,563 A * 3/1974 Hoffmann et al.
3,965,969 A * 6/1976 Williamson
4,225,204 A * 9/1980 Bellavoine
4,250,955 A * 2/1981 Plattner et al.
4,297,558 A * 10/1981 Inayama et al.
4,355,521 A * 10/1982 Tsai
4,582,971 A * 4/1986 Ueda
4,791,861 A * 12/1988 Weinkle et al. ..... 99/357
4,884,626 A * 12/1989 Filipowski ..... 99/357 X
5,154,158 A * 10/1992 Lindsey ..... 126/25 R X
5,503,300 A * 4/1996 Prescott et al. ... 221/150 HC X
5,772,072 A * 6/1998 Prescott et al. ... 221/150 HC X
6,121,593 A * 9/2000 Mansbery et al. ..... 219/679

* cited by examiner

*Primary Examiner*—Ljiljana Ciric
(74) *Attorney, Agent, or Firm*—Meschkow & Gresham, P.L.C.; Lowell W. Gresham; Jordan M. Meschkow

(57) ABSTRACT

A combined refrigerator-oven (20) includes an enclosed chamber (28) having a top wall (22), a bottom wall (24), and vertical side walls (26). The refrigerator-oven (20) further includes a heating unit (50) and a refrigeration unit (70). A controller (118) is in communication with the heating unit (50) and the refrigeration unit (70). When a cooling mode is selected, the controller (118) activates the refrigeration unit (70) to deliver cool air (62) into the enclosed chamber (28). When a heating mode is selected, the controller (118) activates the heating unit (50) to produce heat (66) in the enclosed chamber (28).

20 Claims, 8 Drawing Sheets

| KEY PAD ENTRY | FUNCTION |
|---|---|
| * 1 | SET TIME TO AM AND COMPLETE TIMER COMMAND |
| * 2 | SET TIME TO PM AND COMPLETE TIMER COMMAND |
| # 1 | SET REFRIGERATION UNIT FUNCTIONS<br>(AUTOMATICALLY SET TO 45°) |
| # 4 | SET REFRIGERATION TIMER ON:<br>EX: 1 0 3 0*2 (10:30PM) |
| # 7 | SET REFRIGERATION TIMER OFF:<br>EX: 0 4 0 0*2 (4:00PM) |
| # 2 | SET HEATING ELEMENT FUNCTIONS AND HEATING ELEMENT TEMP<br>EX: 3 5 0# (350°) |
| # 5 | SET HEATING ELEMENT TIMER ON:<br>EX: 0 4 1 0*2 (4:10PM) |
| # 8 | SET HEATING ELEMENT TIMER OFF:<br>EX: 0 52 0*2 (5:20PM) |
| # 3 | SET WARM OVEN FUNCTIONS |
| # 6 | AUTOMATICALLY SETS HEATING ELEMENT TO 175° F<br>HEATING ELEMET TIMER TURNS OFF<br>EX: 0 5 3 0*2 (5:30PM) |
| # 9 | REPEATS FUNCTIONS PROGRAMMED AND<br>AWAITS CONFIRMATION OF SETTING |
| * 0 | CANCEL |
| # 0 | PROGRAMMING COMPLETE. |

157

FIG. 7

COMBINED REFRIGERATOR-OVEN APPARATUS

TECHNICAL FIELD OF THE INVENTION

The present invention relates to the field of kitchen appliances. More specifically, the present invention relates to a combined refrigerator-oven apparatus for refrigerating and cooking food in the same enclosed chamber.

BACKGROUND OF THE INVENTION

Lifestyles are very busy, and many families are away from home during large portions of the day for work, school, and other activities. As a consequence, the preparation of the evening meal can be significantly delayed until the cook returns home. Many families have extracurricular activities in the evenings. Thus, a delay in the preparation of the evening meal can undesirably overlap into the time allotted for these extracurricular activities. This problem is exacerbated if the family member cooking the meal is postponed on his or her return from work or school. This postponement causes the evening meal to be further delayed.

To meet such demanding schedules, many people replace the home-cooked evening meal with low nutritional value snacks, fast food, or by simply skipping meals. This unhealthy replacement for the home-cooked meal contributes to an increase in diet related disorders, such as obesity, heart disease, diabetes, and so forth. Accordingly, there is a need to decrease the preparation time for home-cooked meals following a return from work or school to provide incentive for the preparation and consumption of home-cooked meals rather than snacks and fast food.

Microwave and convection ovens have typically been used to cook meals quickly. Unfortunately, the preparation of a meal entails more than simply cooking the food. In addition to cooking the meal, a cook typically has to prepare the food in advance by cleaning it, cutting it, combining it with other ingredients, and so forth. This advance preparation can be even more time consuming than cooking the food. Sometimes a cook may prepare a meal in advance and store it in the refrigerator until he or she gets home, at which time, the cook will place the food in the oven to bake it. Unfortunately, the baking time can still undesirably delay the time at which the meal may be eaten.

Yet another tactic that cooks use is to place frozen food on the counter to thaw before leaving for work. The thawed food is then cooked upon their return home. Unfortunately, the food may thaw to room temperature before anyone returns home. Thawed foods that reach room temperature, particularly meat products, can become unsafe due to bacterial growth. Hence, it is recommended that most foods should be thawed in the refrigerator, rather than on the countertop.

SUMMARY OF THE INVENTION

Accordingly, it is an advantage of the present invention that a combined refrigerator-oven is provided that permits the selective cooling and cooking of food.

Another advantage of the present invention is that a combined refrigerator-oven is provided that can be pre-programmed to activate respective cooling and heating units of the refrigerator-oven.

Yet another advantage of the present invention is that the combined refrigerator-oven can be remotely controlled to activate the respective cooling and heating units of the combined refrigerator-oven and to change pre-programmed settings of the refrigerator-oven.

The above and other advantages of the present invention are carried out in one form by a combined refrigerator-oven apparatus. The combined refrigerator-oven includes an enclosed chamber having top, bottom, and vertical side walls. The bottom wall has an airflow inlet opening, and a gate removably blocks the airflow inlet opening. A heating unit is positioned in the enclosed chamber, and a refrigeration unit is positioned outside of the enclosed chamber. The refrigeration unit has a cool air duct coupled to the airflow inlet opening. A controller is in communication with the gate, the heating unit, and the refrigeration unit for selectively activating the refrigerator-oven apparatus. When a cooling mode is selected, the controller actuates the gate to unblock the airflow inlet opening and activates the refrigeration unit to deliver cool air through the cool air duct to the enclosed chamber. When a heating mode is selected, the controller actuates the gate to block the airflow inlet opening and activates the heating unit.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 7 shows a table of exemplary keypad codes;

DETAILED DESCRIPTION OF THE PREFERRED EMBODIMENTS

Figure 1:
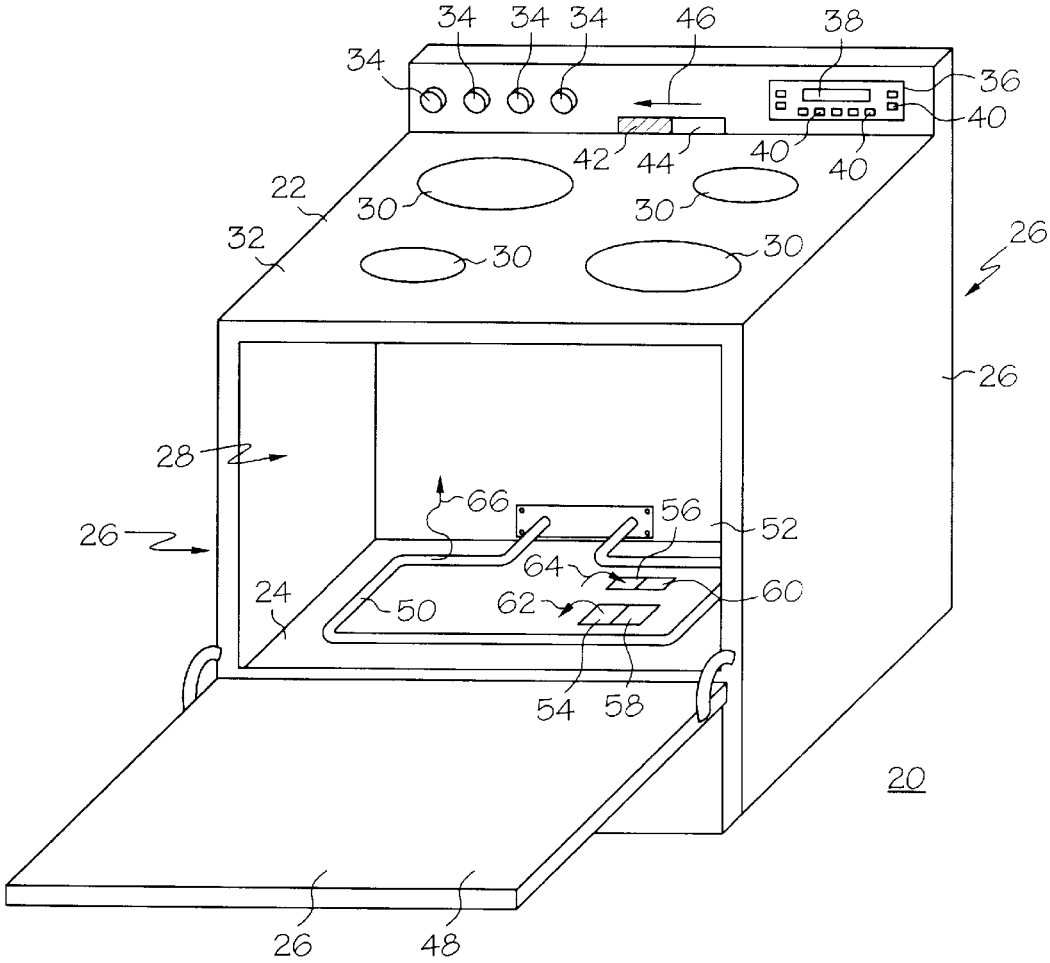
FIG. 1 shows a perspective view of a combined refrigerator-oven in accordance with a preferred embodiment of the present invention.

FIG. 1 shows a perspective view of a combined refrigerator-oven 20 in accordance with a preferred embodiment of the present invention. Refrigerator-oven 20 is a direct replacement for a conventional stove. That is, refrigerator-oven 20 is generally box-shaped having a top wall 22, a bottom wall 24, and vertical side walls 26 forming an enclosed chamber 28. Surface burners 30 are mounted on an outer surface 32 of top wall 22. Refrigerator-oven 20 includes four control knobs 34 for adjusting the temperature of surface burners 30. In addition, refrigerator-oven 20 includes a control panel 36 having a display 38 and selectors 40 for manually controlling the cooling and heating of enclosed chamber 28.

Refrigerator-oven 20 further includes a heat exchange vent 42 extending between enclosed chamber 28 and outer surface 32 of top wall 22. Heat exchange vent 42 is selectively blocked by a motor driven heat exchange vent gate 44. Heat exchange vent gate 44 is shown in an open position to expose heat exchange vent 42. However, heat exchange vent gate 44 is movable, as represented by an arrow 46, to block heat exchange vent 42.

One of vertical side walls 26 is a hinged oven door 48. Oven door 48 is shown in an open position to expose enclosed chamber 28. A heating unit 50 is positioned in enclosed chamber 28. In the exemplary embodiment shown, heating unit 50 is an electrical resistance heating element mounted on an interior surface 52 of one of vertical side walls 26. However, in an alternative embodiment, heating unit 50 may be a gas burner (not shown), as known to those skilled in the art, mounted on interior surface 52.

Only one electrical resistance heating element is shown in enclosed chamber 28. However, it should be readily apparent to those skilled in the art that refrigerator-oven 20 may include a second electrical resistance heating element located on the inside top of enclosed chamber 28 and typically used for broiling food.

An airflow inlet opening 54 and an airflow outlet opening 56 extend through bottom wall 24 of enclosed chamber 28. An airflow inlet gate 58 removably blocks airflow inlet opening 54 (discussed below). Likewise, an airflow outlet gate 60 removably blocks airflow outlet opening 56 (discussed below).

Refrigerator-oven 20 is configured to selectively cool and heat enclosed chamber 28 to preserve food in a cooled state for a finite amount of time and then to cook food at a desired temperature for a finite amount of time. When refrigerator-oven 20 is in a cooling mode, heat exchange vent gate 44 is actuated to a closed position to block heat exchange vent 42. In addition, airflow inlet and outlet gates 58 and 60, respectively, are actuated to an open position to unblock airflow inlet and airflow outlet openings 54 and 56, respectively. Thus, cool air, represented by an arrow 62 and produced by a refrigeration unit located outside of enclosed chamber 28 (discussed below), is delivered through airflow inlet opening 54 into enclosed chamber 28 and warmer air, represented by an arrow 64, is drawn out of enclosed chamber 28 through airflow outlet opening 56.

Conversely, when refrigerator-oven 20 is in a heating mode, heat exchange vent gate 44 is actuated to an open position to unblock heat exchange vent 42. In addition, airflow inlet and outlet gates 58 and 60, respectively, are actuated to a closed position to block airflow inlet and airflow outlet openings 54 and 56, respectively. Heat, represented by an arrow 66, is then produced by heating unit 50 to heat enclosed chamber 28.

Figure 2:
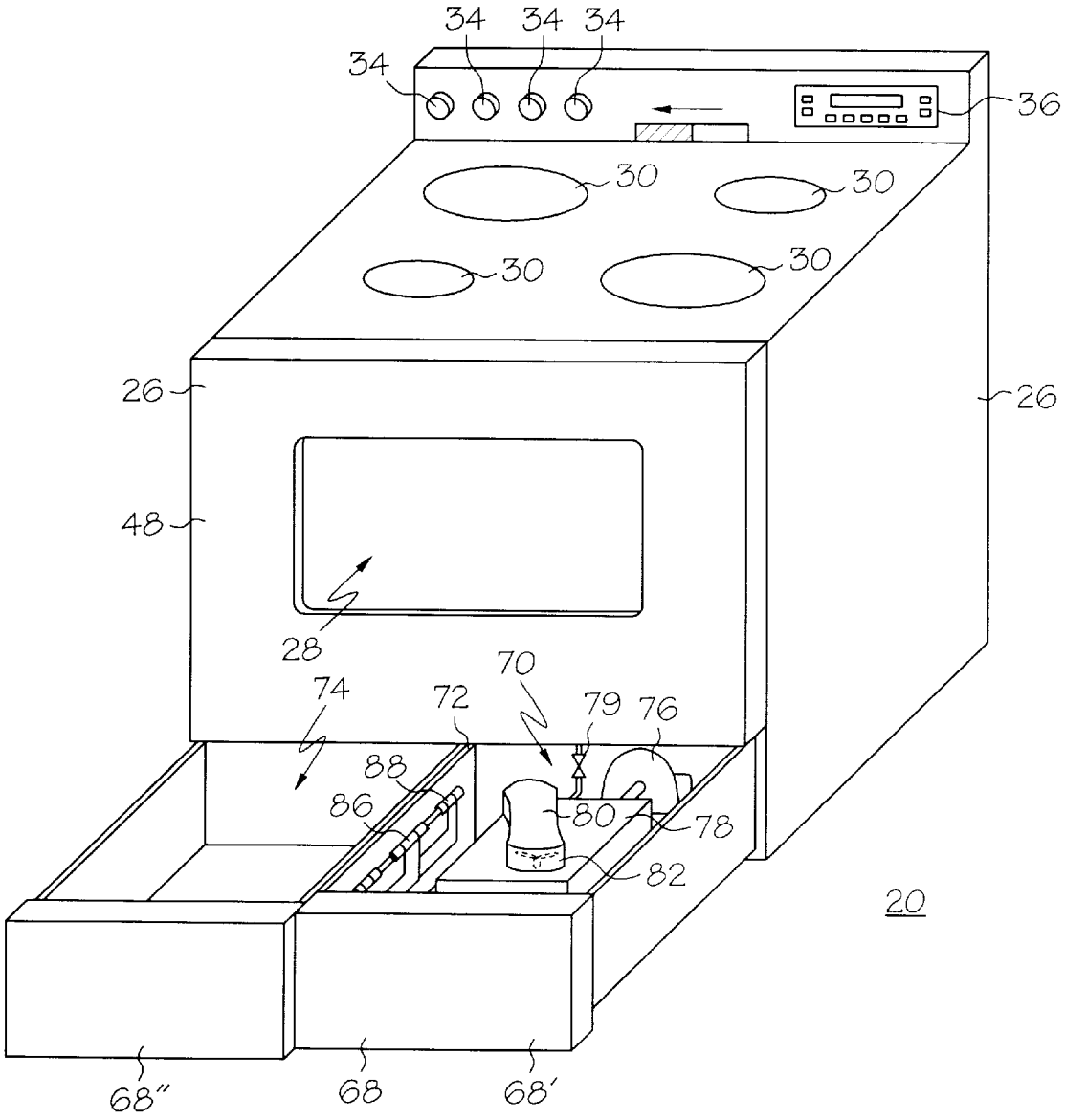
FIG. 2 shows a perspective view of the combined refrigerator-oven with a drawer slidably mounted below an enclosed chamber of the refrigerator-oven.

FIG. 2 shows a perspective view of combined refrigerator-oven 20 with a drawer 68 slidably mounted below enclosed chamber 28. Drawer 68 replaces the conventional drawer used for storage in a conventional stove. Drawer 68 is configured to house components of a refrigeration unit 70 of combined refrigerator-oven 20 outside of enclosed chamber 28 and below bottom wall 24 (FIG. 1).

Drawer 68 includes a partition 72 separating refrigeration unit 70 from a storage section 74 in drawer 68. As shown in FIG. 2, drawer 68 may include a first drawer section 68' for housing refrigeration unit 70 and a second drawer section 68" for storage section 74. First and second drawer sections 68' and 68", respectively, may be separately slide mounted so that refrigeration unit 70 need not be exposed each time storage section 74 is accessed. Alternatively, drawer 68 may be a single unit with partition 72 simply separating first and second drawer sections 68' and 68". In another alternative embodiment, a drawer front of drawer 68 may extend across the entire front of refrigerator-oven 20, while only storage section 74, extending halfway across the front of refrigerator-oven 20, is outwardly slidable. In such a scenario, when drawer 68 is closed, drawer 68 conceals a stationary mounted refrigeration unit 70.

The components of refrigeration unit 70 located in drawer 68 include a compressor 76, an evaporator 78, an expansion valve 79, and a cool air duct 80 in communication with evaporator 78. An evaporator fan 82 is interposed between cool air duct 80 and a cool air outlet 84 (see FIG. 4) of evaporator 78. When drawer 68 is slid below enclosed chamber 28, cool air duct 80 is coupled to airflow inlet opening 54 (FIG. 1) so that cool air 62 produced at evaporator 78 is drawn away from evaporator 78 by evaporator fan 82, into cool air duct 80, and through airflow inlet opening 54 (FIG. 1) to cool enclosed chamber 28 (FIG. 1).

A first solenoid element 86 and a second solenoid element 88 are mounted below enclosed chamber 28 (FIG. 1). First solenoid element 86 couples to airflow inlet gate 58 (FIG. 1) to move gate 58 between open and closed positions. Likewise, second solenoid element 88 couples to airflow outlet gate 60 to move gate 60 between open and closed positions, as discussed in greater detail below.

Figure 3:
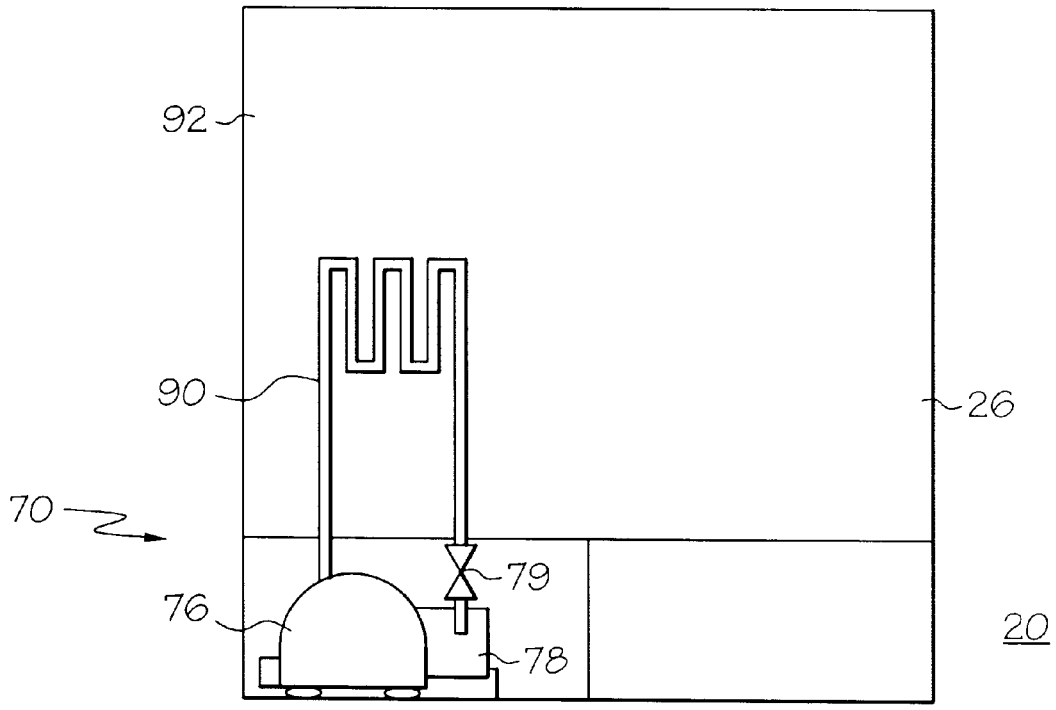
FIG. 3 shows a back view of the combined refrigerator-oven.

FIG. 3 shows a back view of the combined refrigerator-oven 20. A condenser 90 of refrigeration unit 70 is mounted on an outer surface 92 of one of vertical side walls 26. In particular, condenser 90 is mounted to the back one of vertical side walls 26 so that condenser 90 is not visible when refrigerator-oven 20 is in place.

Figure 4:
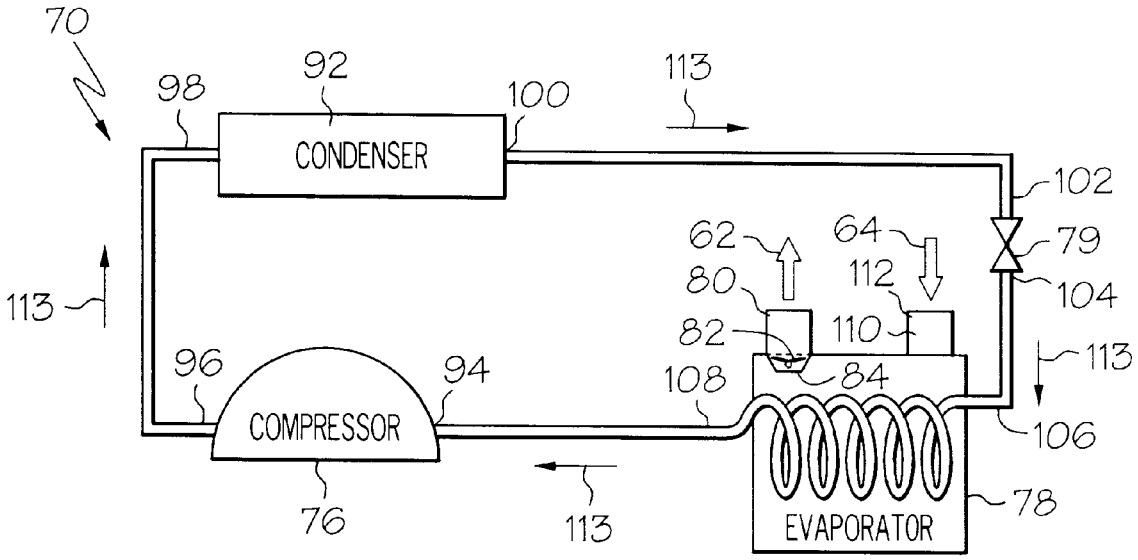
FIG. 4 shows a block diagram of a refrigeration cycle performed by a refrigeration unit of the combined refrigerator-oven.

FIG. 4 shows a block diagram of a refrigeration cycle performed by refrigeration unit 70 of combined refrigerator-oven 20. Compressor 76 includes a first inlet 94 and a first outlet 96. Likewise, condenser 90 includes a second inlet 98, in fluid communication with first outlet 96, and a second outlet 100. Expansion valve 79 has a third inlet 102, in fluid communication with second outlet 100, and a third outlet 104. And evaporator 78 has a fourth inlet 106, in fluid communication with third outlet 104, and a fourth outlet 108. Thus, fourth inlet 106 of evaporator 78 is in fluid communication with second outlet 100 of condenser 90 via expansion valve 79. Fourth outlet 108 of evaporator 78 is in fluid communication with first inlet 94 of compressor 76.

Evaporator fan 82 is interposed between cool air duct 80 and a cool air outlet 84 of evaporator 78. Evaporator 78 also includes a warm air inlet 110 coupled to a warm air duct 112. When drawer 68 (FIG. 2) is slid below enclosed chamber 28 (FIG. 2), warm air duct 112 couples to-airflow outlet opening 56 (FIG. 1).

Refrigeration unit 70 performs a refrigeration cycle to withdraw heat from enclosed chamber 28 (FIG. 1) so that the temperature in enclosed chamber 28 will be lower than the ambient temperature of the surroundings, i.e., the kitchen. Refrigeration unit 70 is a closed-loop system that uses a fluid, or refrigerant, to move heat from one place to another.

In particular, cool, liquid refrigerant enters fourth inlet 106 of evaporator 78. The refrigerant in evaporator 78 absorbs heat from enclosed chamber 28 via warm air duct 112 and changes state from a liquid to a vapor. The vapor refrigerant exits evaporator 78 through fourth outlet 108 and moves into compressor 76 through first inlet 94. Compressor 76 raises the pressure and temperature of the refrigerant so that the refrigerant will move through refrigeration unit 70.

The increase in pressure causes the refrigerant to flow out of first outlet 96 of compressor 76 and into condenser 90 via second inlet 98.

Condenser 90 releases heat from the refrigerant to the outside air. Refrigeration unit 70 may include a condenser fan (not shown) for facilitating the movement of heat away from condenser 90. The vapor refrigerant exits from condenser 90 via second outlet 100 then reaches third inlet 102 of expansion valve 79. At expansion valve 79, the refrigerant "flashes" through expansion valve 79 to-reduce the pressure and cool the refrigerant to the point where it returns to a liquid state. The cool, liquid refrigerant exits expansion valve 79 through third outlet 104 and re-enters evaporator 78 via fourth inlet 106. Upon entering evaporator 78, the liquid refrigerant absorbs heat from warmer air 64 drawn into evaporator 78 through warm air duct 112. As warmer air 64 passes over evaporator 78, it gives up some of its heat to produce cool air 62 which is re-circulated by evaporator fan 82 through cool air duct 80 and back into enclosed chamber 28. Arrows 113 illustrate the flow of refrigerant through refrigeration unit 70.

Figure 5:
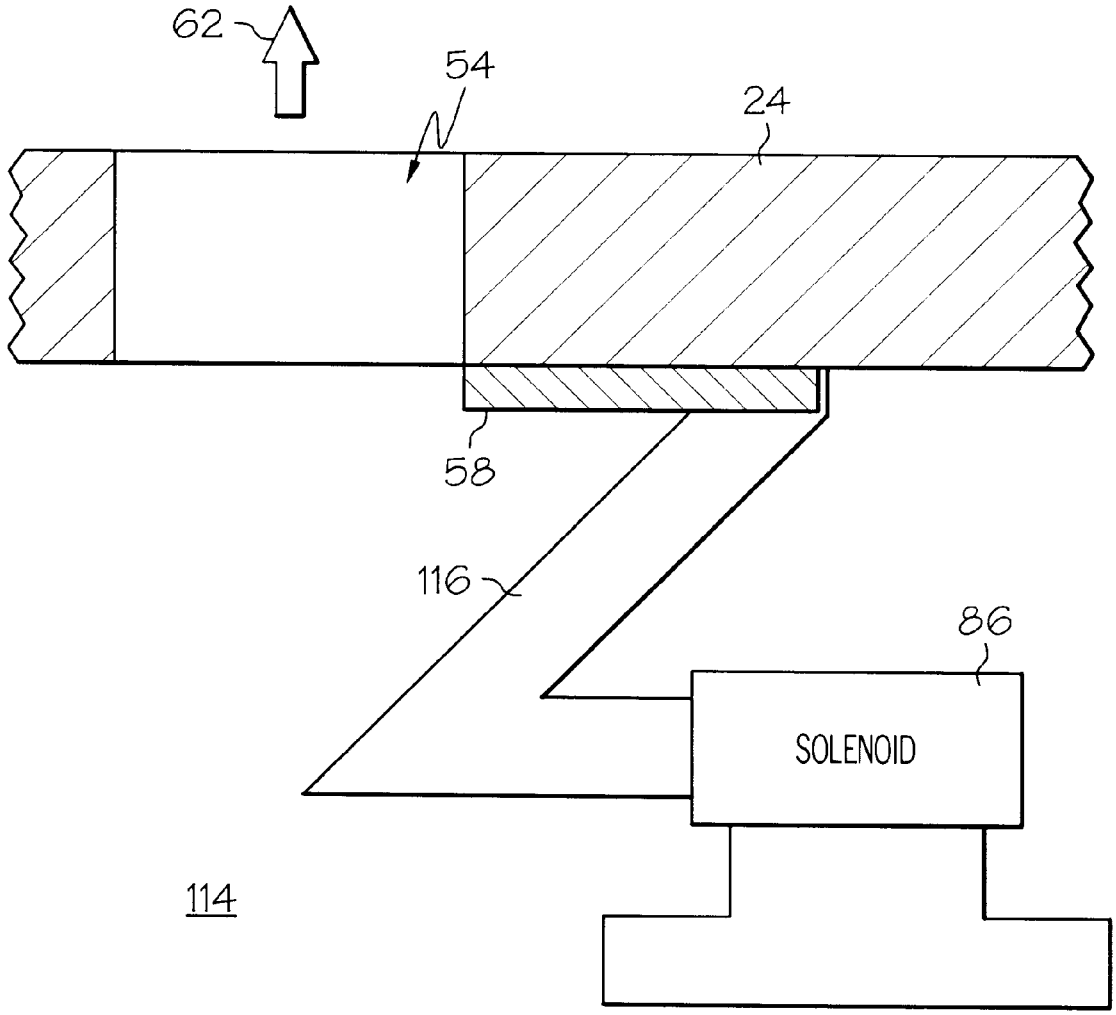
FIG. 5 shows a partial sectional side view of a gate assembly of the refrigerator-oven.

FIG. 5 shows a partial sectional side view of a gate assembly 114 of refrigerator-oven 20. Gate assembly 114 includes airflow inlet gate 58, first solenoid element 86, and an armature 116 coupling airflow inlet gate 58 to a movable iron core (not shown) of first solenoid element 86. Gate assembly 114 is configured to mount below bottom wall 24 of enclosed chamber 28 so that airflow inlet gate 58 removably blocks airflow inlet opening 54 extending through bottom wall 24. That is, when first solenoid element 86 is energized, current passes through a coil surrounding the iron core. The iron core is pulled into the center of the coil, or winding, of the solenoid in response to the current. As the iron core is pulled into the center of the winding, armature 116 and consequently, airflow inlet gate 58 move to an open position to unblock airflow inlet opening 54 extending through bottom wall 24.

When first solenoid element 86 is de-energized, a spring (not shown) pulls the movable core away from the center of the winding. As a result armature 116 and airflow inlet gate 58 move to a closed position to block airflow inlet opening 54. First solenoid element 86 is energized when cooling of refrigerator-oven 20 (FIG. 1) is desired to allow passage of cool air 62 into enclosed chamber 28 (FIG. 1). Additionally, first solenoid element 86 is de-energized when cooling of refrigerator-oven 20 (FIG. 1) is not desired.

Although gate assembly 114 is described in terms of airflow inlet gate 58 and first solenoid element 86, it should be understood, that refrigerator-oven 20 includes another gate assembly 114 to selectively block and unblock airflow outlet opening 56 (FIG. 1). Those skilled in the art will recognize that other devices may be employed to actuate movement of airflow inlet and outlet gates 58 and 60, respectively. For example, small motor assemblies may be used. Alternatively, a single solenoid or single motor with a dual connection point armature may be used that couples to both inlet and outlet gates 58 and 60 and moves them concurrently.

Figure 6:
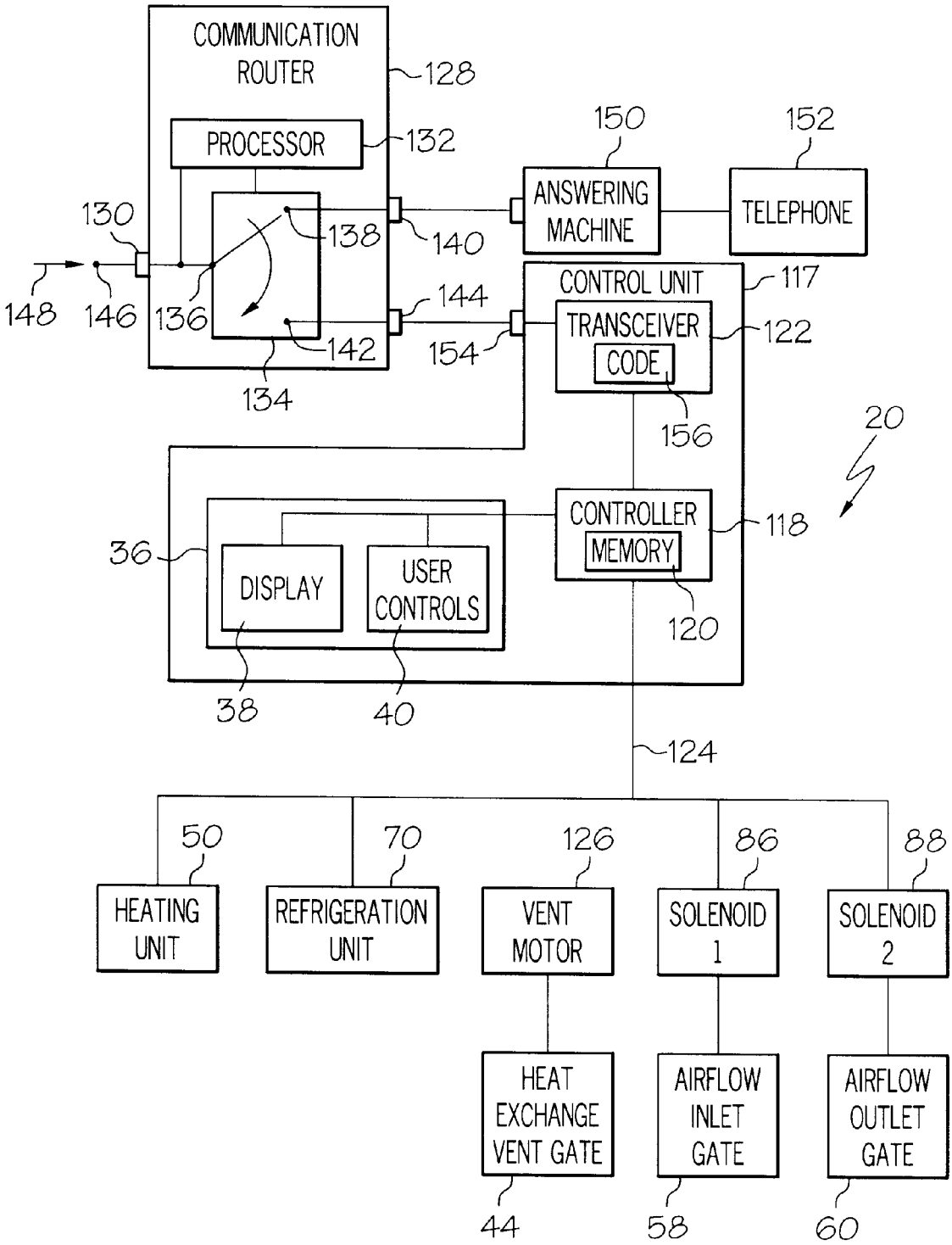
FIG. 6 shows a functional block diagram of the refrigerator-oven.

FIG. 6 shows a functional block diagram of refrigerator-oven 20. Refrigerator-oven 20 includes a control unit 117 that manages all of the functions of refrigerator-oven 20. Control unit 117 includes controller 118 with an electrically erasable programmable read only memory (EEPROM) 120 for control program storage and operation, display 38, user controls (selectors) 40, and a transceiver 122. Controller 118 is in communication, via a communication bus 124, with each of heating unit 50, refrigeration unit 70, a vent motor 126 controlling the movement of heat exchange vent gate 44, first solenoid element 86 controlling the movement of airflow inlet gate 58, and second solenoid element 88 controlling the movement of airflow outlet gate 60.

In operation, controller 118 executes the control program stored in memory 120 to manage the multiple functions of refrigerator-oven 20. These functions include receiving operating commands and data from user controls 40; displaying cooking times and related information on display 38; monitoring safety interlock switches, such as temperature sensors; sending control signals to power alternative current switch (ACS) elements (not shown), which in turn actuate gates 44, 58, and 60, activate heating unit 50, and activate refrigeration unit 70; manage internal clock and timing functions; and respond to control requests received at transceiver 122 submitted from remote locations.

Refrigerator-oven 20 further includes a communication router 128 in selective communication with transceiver 122 of control unit 117. Communication router 128 enables an individual at a remote location to selectively activate heating and refrigeration units 50 and 70, respectively, of the combined refrigerator-oven, to pre-select times and temperatures in which heating and refrigeration units 50 and 70 are to operate, and to change pre-programmed settings of the refrigerator-oven.

Communication router 128 generally includes a communication input 130, a processor 132 in communication with communication input 130, and a switch 134 controllable by processor 132. Switch 134 has a switch input 136 coupled to communication input 130. In addition, switch 134 has a first switch output 138 coupled to a first communication output 140 of communication router 128, and a second switch output 142 coupled to a second communication output 144 of communication router 128.

Communication input 130 is configured for connection to an external link 146, such as a telephone wall jack, for receiving a message 148 from a remote location. First communication output 140 of communication router 128 is configured to interconnect with a telephone answering machine 150, which is in turn interconnected with a telephone 152. Second communication output 144 of communication router 128 interconnects with an input 154 of transceiver 122 of control unit 117.

Communication router 128 is a phone line manager that allows more than one device, i.e., answering machine 150 and transceiver 122 having modem capability, to utilize a single telephone line, i.e. external link 146. That is, communication router 128 manages incoming calls, i.e., message 148, to route them to either answering machine 150 or transceiver 122.

Although the present invention is described in terms of a phone line manager and interconnection with a telephone jack, it should be understood, that the present invention may be adapted for use with an Internet connection such as a high speed cable link, a radio communication link, and so forth.

When message 148 is received at communication input 130, processor 132 automatically responds to the caller with call direction options. The options may be, for example, "Press 1 to leave a message on the answering machine or press 2 to access the refrigerator-oven controls."

When processor 132 identifies message 148 as being a telephone call, i.e., detects a "1", processor 132 enables switch 134 to route message 148 from switch input 136 to first switch output 138 so that message 148 is communicated from communication input 130 to answering machine 150 for conventional telephone call answering processes.

Alternatively, when processor 132 identifies message 148 as being a refrigerator-oven control request, i.e., detects a "2", processor 132 enables switch 134 to route message 148 from switch input 136 to second switch output 142 so that message 148 is communicated from communication input 130 to transceiver 122 of control unit 117.

In response to receipt of message 148, transceiver 122 transmits a request, in the form of a verbal message, to external link 146 for an access code. For example, the verbal message may recite "Please enter access code followed by a pound sign". Transceiver 122 then waits for an authorized access code.

When an access code is received-in a return message at transceiver 122 from external link 146, transceiver 122 compares the received access code with an authorized access code (CODE) 156 stored in a memory element of transceiver 122. If the received access code matches authorized access code 156, transceiver 122 enables communication between second switch output 142 and controller 118. However, if the access code does not match authorized access code 156 or no access code is received, transceiver 122 will authorize a disconnection of second switch output 142 and control unit 117.

Once communication between second switch output 142 and controller 118 is enabled, a remote communication portion of the control program stored in memory 120 is executed by controller 118. Via a series of verbal prompts, the remote communication portion of the control program instructs an individual calling from a remote location to program refrigerator-oven 20. Control of refrigerator-oven 20 is programmed through keypad entry at the remote location.

FIG. 7 shows a table 157 of exemplary keypad codes. An exemplary verbal instruction may be "Press #1 to select refrigerator functions. Press #2 to select oven functions. Press #3 to select warmer functions. Press *0 to exit this menu." If, for example, "#1" is pressed on the telephone keypad the next verbal instruction may be "Press #4 to set refrigerator timer ON. Press #5 to set refrigerator timer OFF. Press *0 to exit this menu." The verbal instruction set would continue until a #0 is detected indicating that the programming is complete.

Figure 8:
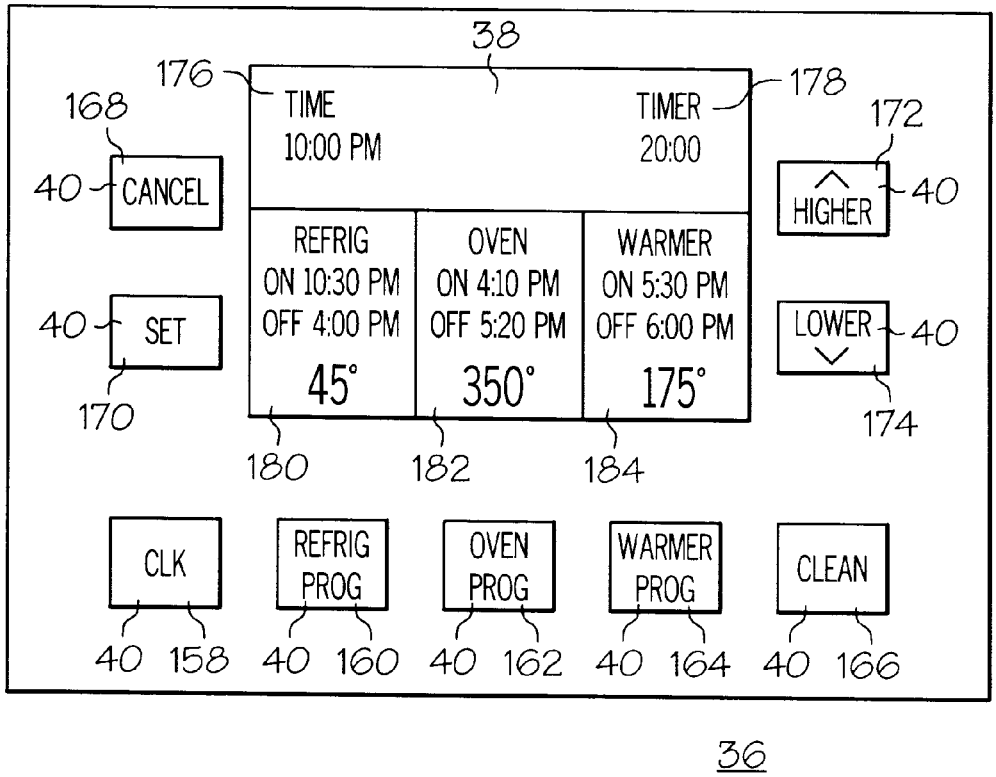
FIG. 8 shows a front view of an exemplary control panel of the refrigerator-oven.

FIG. 8 shows front view of control panel 36 of refrigerator-oven 20. While, remote control of refrigerator-oven 20 is possible though communication router 128, control panel 36 allows for local control of refrigerator-oven 20. In other words, user controls 40 provide an individual with the capability to program refrigerator-oven 20 in each of cooling, heating, and warming modes at pre-selected times and temperatures.

User controls 40, or selectors, include a clock control button (CLK) 158, a refrigerator program button (REFRIG PROG) 160, an oven program button (OVEN PROG) 162, a warmer program button (WARMER PROG) 164, and oven cleaning button (CLEAN) 166. Other user controls 40 include a CANCEL button 168, a SET button 170, a HIGHER button 172, and a LOWER button 174.

In an alternative embodiment, the control program in memory 120 of controller 118 (FIG. 6) may include voice recognition software. In addition, the user controls may include a button and a microphone for enabling controller 118 to receive verbal instructions from the user. In another alternative embodiment, the selector, or user controls, may be realized using a touchscreen display.

Display 38 includes a current time field 176, a countdown timer field 178, a refrigerator settings field 180, an oven settings field 182, and a warmer setting field 184. Display 38 may utilize a light emitting diode (LED) technology, or a liquid crystal display (LCD) technology, or another display technology for providing a user with visual cues.

In order to program refrigerator-oven locally, the user presses a desired button for a desired function. The user may optionally set the timer functions using HIGHER button 172 and LOWER button 174.

Referring back to FIG. 6 in connection with FIG. 8, when a cooling mode is selected, either through remote control or local control, controller 118 sends a control signal to vent motor 126 to actuate, or move, heat exchange vent gate 44 to a closed position to block heat exchange vent 42 (FIG. 1). In addition, controller 118 sends control signals to each of first and second solenoid elements 86 and 88, respectively, that energize elements 86 and 88 thereby actuating airflow inlet gate 58 and airflow outlet gate 60 to unblock airflow inlet and outlet openings 54 and 56, respectively. Controller 118 further sends a control signal to refrigeration unit 70 that activates refrigeration unit 70 to deliver cool air 62 (FIG. 1) to enclosed chamber 28 (FIG. 1). The cooling mode is convenient so that food prepared ahead of time can be stored and/or thawed safely in a cooled state until cooking time.

When a heating mode is selected, either through remote control or local control, controller 118 sends a control signal to refrigeration unit 70 deactivating refrigeration unit 70. Controller then sends a control signal to vent motor 126 to actuate, or move, heat exchange vent gate 44 to an open position thereby unblocking heat exchange vent 42 to allow room temperature heat into enclosed chamber 28. In addition, controller 118 sends control signals to each of first and second solenoid elements 86 and 88, respectively, that de-energize elements 86 and 88 to actuating airflow inlet gate 58 and airflow outlet gate 60 to block airflow inlet and outlet openings 54 and 56, respectively. Controller 118 further sends a control signal to heating unit 50 that activates heating element to produce heat 66 (FIG. 1) at the pre-selected temperature, for example, 350° F., in enclosed chamber 28 (FIG. 1).

Another feature of refrigerator-oven 20 is the ability to program refrigerator-oven 20 to operate in a warming mode. The warming mode may be used following the heating mode to keep already cooked food warm. The warming mode is convenient for keeping the prepared warm if consumption of the evening meal is somehow postponed. As such, when warming mode follows the heating mode, controller 118 sends a control signal to heating unit 50 that directs heating unit 50 to produce heat 66 at approximately 175° F. When warming mode follows a cooling mode, or when refrigerator-oven has been powered off, controller 118 sends control signals, like those described in connection with the heating mode so that heat exchange vent 42 is unblocked, and each of airflow inlet and outlet openings 54 and 56 are blocked.

Figure 9:
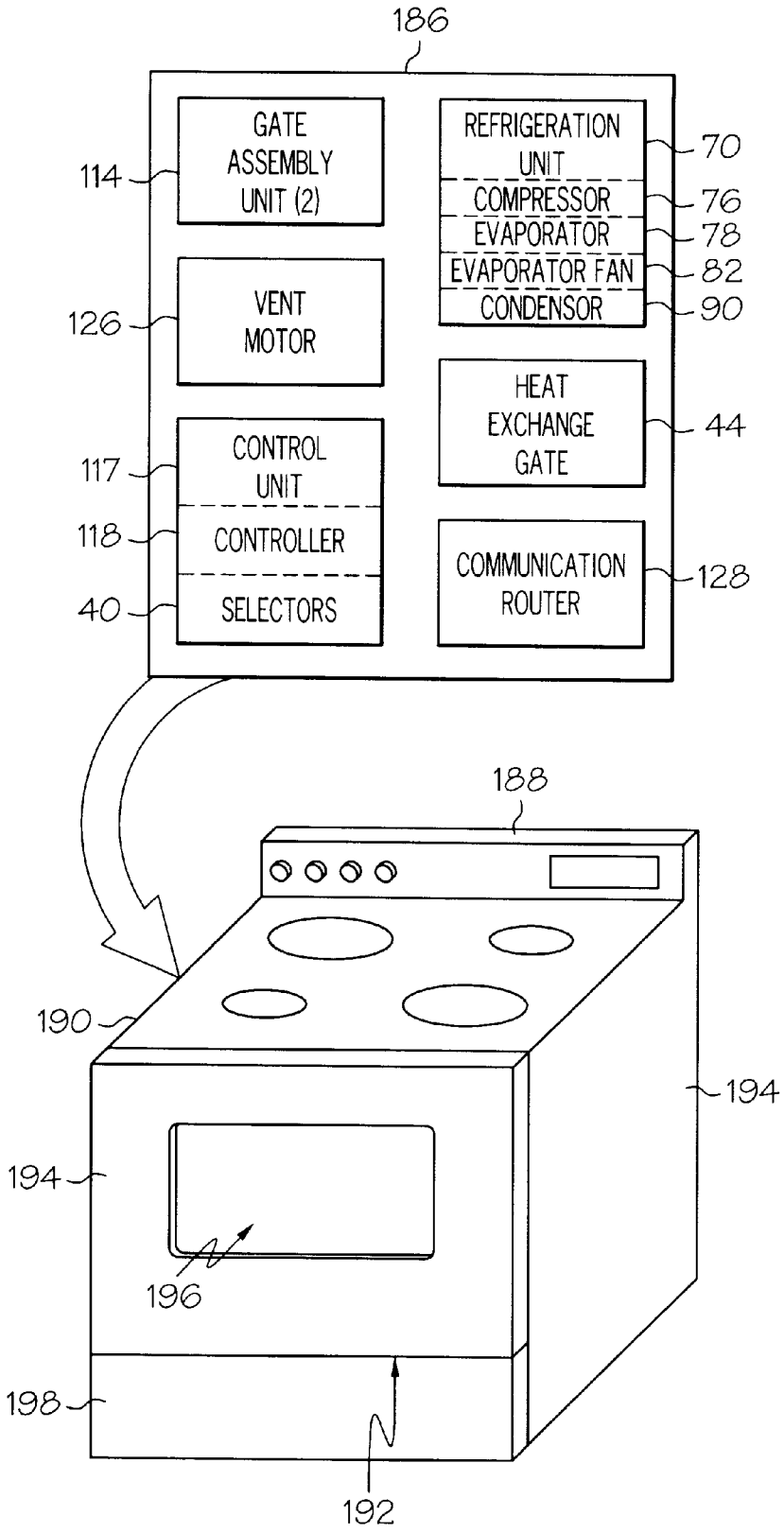
FIG. 9 shows an adapter kit for converting a conventional oven to a combined refrigerator-oven apparatus in an alternative embodiment of the present invention.

FIG. 9 shows an adapter kit 186 for converting a conventional oven to a combined refrigerator-oven apparatus in an alternative embodiment of the present invention. Refrigerator-oven 20 is described in terms of a new appliance to replace existing stoves. However, in the alternative embodiment, adapter kit 186 includes the components and instructions need to convert a conventional, pre-existing oven into a combined refrigerator-oven apparatus, such as refrigerator-oven 20. It is anticipated that adapter kit 186 may be used by a trained technician to perform the conversion.

An exemplary conventional stove 188 is shown having a top wall 190, a bottom wall 192, and vertical side walls 194 forming an enclosed cavity 196. In addition, stove 188 includes a drawer 198. Adapter kit 186 includes a replacement drawer, such as drawer 68 (FIG. 2) that includes two gate assemblies 114 and refrigeration unit 70. During the conversion, drawer 198 is removed from stove 188 and replaced with a drawer similar to drawer 68 and the appropriate connections are made as described in connection with FIG. 2. In addition, condenser 90 (FIG. 3) in installed on the back one of vertical side walls 194.

Adapter kit 186 also includes heat exchange vent gate 44 and vent motor 126, control unit 117, and communication router 128. Heat exchange vent gate 44 and vent motor 126 are installed on top wall 190 of stove 188. The original control panel of stove 188 is removed and replaced by control unit 117. In addition, communication router 128 is connected to the telephone wall jack and lines are run to interconnect first communication output 140 to answering machine 150 and to interconnect second communication output 144 to input 154 (FIG. 6) to transceiver 122 of control unit 117.

In summary, the present invention teaches a combined refrigerator-oven is provided that permits the selective cooling and cooking of food. In particular, refrigerator-oven includes separately controlled heating and refrigeration units. Accordingly, foods prepared ahead of time, either frozen or thawed, may be kept cool until it is time for the food to be baked. In addition, the food can be kept warm until it is time for the food to be consumed. The combined refrigerator-oven is pre-programmable locally using user controls on the control panel to activate the heating and refrigeration units at pre-selected times and temperatures. In addition, the combined refrigerator-oven includes a communication router for enabling remote control of the combined refrigerator-oven.

Although the preferred embodiments of the invention have been illustrated and described in detail, it will be readily apparent to those skilled in the art that various modifications may be made therein without departing from the spirit of the invention or from the scope of the appended claims. For example, the heating element may be a microwave or convection oven apparatus.

What is claimed is:

1. A combined refrigerator-oven apparatus comprising:

an enclosed chamber including top, bottom, and vertical side walls, said bottom wall having an airflow inlet opening;

a gate removably blocking said airflow inlet opening;

a heating unit positioned in said enclosed chamber;

a refrigeration unit positioned outside of said enclosed chamber and having a cool air duct coupled to said airflow inlet opening; and a controller in communication with said gate, said heating unit, and said refrigeration unit for selectively activating said refrigerator-oven apparatus; wherein when a cooling mode is selected, said controller actuates said gate to unblock said airflow inlet opening and activates said refrigeration unit to deliver cool air through said cool air duct to said enclosed chamber; and when a heating mode is selected, said controller actuates said gate to block said airflow inlet opening and activates said heating unit.

2. A combined refrigerator-oven apparatus as claimed in claim 1 further comprising surface burners mounted on top of said enclosed chamber.

3. A combined refrigerator-oven apparatus as claimed in claim 1 wherein:

said enclosed chamber has an airflow outlet opening;

said refrigeration unit has a return air duct coupled to said airflow outlet opening; and said apparatus further includes a second gate removably blocking said airflow outlet opening, said controller being in communication with said second gate to actuate said second gate to unblock said airflow outlet opening when said cooling mode is selected and to block said airflow outlet opening when said heating mode is selected.

4. A combined refrigerator-oven apparatus as claimed in claim 1 wherein said heating unit includes one of an electrical resistance heating element and a gas burner mounted on an interior surface of said enclosed chamber.

5. A combined refrigerator-oven apparatus as claimed in claim 1 wherein:

said enclosed chamber has a heat exchange vent; and said apparatus further includes a second gate removably blocking said heat exchange vent, said controller being in communication with said second gate to actuate said second gate to block said heat exchange vent when said cooling mode is selected and to unblock said heat exchange vent when said heating mode is selected.

6. A combined refrigerator-oven apparatus as claimed in claim 1 wherein said apparatus includes a drawer slidably mounted below said enclosed chamber for housing said refrigeration unit.

7. A combined refrigerator-oven apparatus as claimed in claim 1 wherein said drawer includes a partition separating said refrigeration unit from a storage section in said drawer.

8. A combined refrigerator-oven apparatus as claimed in claim 1 wherein said refrigeration unit comprises:

a compressor having a first inlet and a first outlet;

a condenser having a second inlet and a second outlet, said second inlet in fluid communication with said first outlet;

an evaporator having a third inlet and a third outlet, said third inlet in fluid communication with said second outlet, and said third outlet in fluid communication with said first inlet; and an evaporator fan interposed between a cool air outlet of said evaporator and said cool air duct for drawing cool air away from said evaporator and into said cool air duct to cool said enclosed chamber.

9. A combined refrigerator-oven apparatus as claimed in claim 8 wherein:

said compressor, evaporator, and evaporator fan are mounted below said bottom wall of said enclosed chamber; and said condenser is mounted on an outer surface of one of said vertical side walls.

10. A combined refrigerator-oven apparatus as claimed in claim 8 wherein said apparatus further includes a drawer slidably mounted below said enclosed chamber, and said compressor, evaporator, and evaporator fan are located in said drawer.

11. A combined refrigerator-oven apparatus as claimed in claim 1 further comprising a selector in communication with said controller for pre-selecting said cooling and heating modes and for pre-selecting times and temperatures in which said refrigeration unit and said heating unit are to operate in each of said cooling and heating modes.

12. A combined refrigerator-oven apparatus as claimed in claim 1 further comprising a communication router in selective communication with said controller, said communication router being configured to enable an individual at a remote location to pre-select said cooling and heating-modes and to pre-select times and temperatures in which said refrigeration unit and said heating unit are to operate in each of said cooling and heating modes.

13. A combined refrigerator-oven apparatus as claimed in claim 12 wherein said communication router comprises:

a communication input configured for connection to an external link for receiving a message from said remote location;

a processor in communication with said communication input, said processor identifying said message as one of a telephone call and a-refrigerator-oven control request;

a switch controllable by said processor, said switch having a switch input coupled to said communication input, a first switch output in communication with a telephone answering machine, and a second switch output in communication with said controller; wherein when said processor identifies said message as said telephone call, said processor enables said switch to route said message from said communication input to said first switch output; and when said processor identifies said message as said refrigerator-oven control request, said processor enables said switch to route said message from said communication input to said second switch output.

14. A combined refrigerator-oven apparatus as claimed in claim 13 further comprising a data receiver in communication with each of said second switch output and said controller, said data receiver enabling communication between said second switch output and said controller in response to a received authorized access code.

15. A combined refrigerator-oven apparatus comprising:

an enclosed chamber including top, bottom, and vertical side walls, said bottom wall having an airflow inlet opening;

surface burners mounted on top of said enclosed chamber;

a gate removably blocking said airflow inlet opening;

a heating unit positioned in said enclosed chamber, said heating unit including one of an electrical resistance heating element and a gas burner mounted on an interior surface of said enclosed chamber;

a refrigeration unit positioned outside of said enclosed chamber, said refrigeration unit including:

a cool air duct coupled to said airflow inlet opening of said enclosed chamber;

a compressor having a first inlet and a first outlet;

a condenser having a second inlet and a second outlet, said second inlet in fluid communication with said first outlet;

an evaporator having a third inlet and a third outlet, said third inlet in fluid communication with said second outlet, and said third outlet in fluid communication with said first inlet; and an evaporator fan interposed between a cool air outlet of said evaporator and said cool air duct for drawing cool air away from said evaporator and into said cool air duct to cool said enclosed chamber; and a controller in communication with said gate, said heating unit, and said refrigeration unit for selectively activating said refrigerator-oven apparatus; wherein when a cooling mode is selected, said controller actuates said gate to unblock said airflow inlet opening and activates said refrigeration unit to deliver cool air through said cool air duct to said enclosed chamber; and when a heating mode is selected, said controller actuates said gate to block said airflow inlet opening and activates said heating unit.

16. A combined refrigerator-oven apparatus as claimed in claim 15 wherein:

said compressor, evaporator, and evaporator fan are mounted below said bottom wall of said enclosed chamber; and said condenser is mounted on an outer surface of one of said vertical side walls.

17. A combined refrigerator-oven apparatus as claimed in claim 15 wherein:

said enclosed chamber has a heat exchange vent; and said apparatus further includes a second gate removably blocking said heat exchange vent, said controller being in communication with said second gate to actuate said second gate to block said heat exchange vent when said cooling mode is selected and to unblock said heat exchange vent when said heating mode is selected.

18. A combined refrigerator-oven apparatus as claimed in claim 15 further comprising a selector in communication with said controller for pre-selecting said cooling and heating modes and for pre-selecting times and temperatures in which said refrigeration unit and said heating unit are to operate in each of said cooling and heating modes.

19. An adapter kit for converting an oven to a combined refrigerator-oven apparatus, said oven including an enclosed chamber having top, bottom, and vertical side walls, and said oven including a heating unit positioned in said enclosed chamber, said adapter kit comprising:

a gate assembly configured for mounting below said bottom wall of said enclosed chamber to removably block an airflow inlet opening into said enclosed chamber;

a refrigeration unit including:

a compressor having a first inlet and a first outlet;

a condenser having a second inlet and a second outlet, said second inlet configured for placement in fluid communication with said first outlet;

an evaporator having a third inlet and a third outlet, said third inlet configured for placement in fluid communication with said second outlet, and said third outlet configured for placement in fluid communication with said first inlet; and an evaporator fan configured for connection to a cool air outlet of said evaporator and configured to draw cool air away from said evaporator; and a control unit installable into said oven, said control unit including:

a controller configured to control each of said gate assembly, said heating unit, and said refrigeration unit; and a selector in communication with said controller for enabling an individual to instruct said controller to operate in each of a heating and cooling mode, and to pre-select times and temperatures in which said refrigeration unit and said heating unit are to operate in each of said cooling and heating modes.

20. An adapter kit as claimed in claim 19 further comprising a communication router configured for selective communication with said controller of said control unit, said communication router being configured to enable an individual at a remote location to pre-select said cooling and heating modes and to pre-select times and temperatures in which said refrigeration unit and said heating unit are to operate in each of said cooling and heating modes.

* * * * *